United States Patent [19]

Thompson et al.

[11] Patent Number: 4,813,542

[45] Date of Patent: Mar. 21, 1989

[54] STACKING SYSTEM FOR CONTAINERS

[75] Inventors: Marvin W. Thompson, Pasadena; James A. Scott, Anaheim; Timothy C. Jennings, Arcadia; Joseph Neves, West Covina, all of Calif.; Ronald W. Phenicie, Warrenton, Va.; Margaret H. Murphy, La Verne, Calif.

[73] Assignee: Anvil Cases, Inc., Rosemead, Calif.

[21] Appl. No.: 887,592

[22] Filed: Jul. 21, 1986

[51] Int. Cl.[4] ..... B65D 21/02

[52] U.S. Cl. ..... 206/504; 190/37; 206/508; 220/1.5; 220/23.4; 220/23.6

[58] Field of Search ..... 206/504, 508; 220/1.5, 220/23.4, 23.6; 190/37

[56] References Cited

U.S. PATENT DOCUMENTS

| | | | |
|---|---|---|---|
| 2,626,025 | 1/1953 | Sherman | 190/37 |
| 3,331,529 | 7/1967 | Slapnik | 206/508 |
| 3,346,137 | 10/1967 | Ricci | 206/504 |
| 3,749,273 | 7/1973 | Wreghitt | 206/504 |
| 3,811,747 | 5/1974 | Levin | 220/1.5 |
| 3,836,043 | 9/1974 | Levin | 206/504 |

*Primary Examiner*—George E. Lowrance

*Attorney, Agent, or Firm*—Reed Smith Shaw & McClay

[57] ABSTRACT

The disclosure relates to a system for stacking cases in a nesting relationship. A number of cases, each substantially identical to the other are configured to permit stacking in a nested relationship in a number of directions. Each such case includes corner brackets with recesses and protrusions which interact with complementary brackets on adjacent cases. Corner brackets in cooperation with other edge brackets also permit stacking in a nested relationship when the covers for these cases are removed and the orientation of the cases is shifted. A latching means is also provided to secure the cover in place without adversely affecting the latching mechanism.

21 Claims, 5 Drawing Sheets

STACKING SYSTEM FOR CONTAINERS

BACKGROUND AND DISCUSSION OF THE INVENTION

Often when packing equipment, and particularly equipment which is complex and highly sensitive to movement, it is necessary that it be packed in strengthened cases for protection during travel, loading and unloading. The structural elements for strengthening often prevent the cases from being readily stacked in any orderly manner. As a result, attempts to stack a number of these cases on a pallet or any other platform for loading purposes is met with a number of problems. The cases can be skewed causing one case to slide on another and resulting in an awkward and disorderly arrangement. If cases are secured to the pallet by banding, the skewed arrangement under the pressure of the hand may damage the case and eventually the contents.

Another reason cases cannot be stacked in an orderly fashion is the need for ancillary equipment. Latching systems are used to hold covers in place, and handles are employed for transporting individual cases. Typically these items have a number of protrusions which impede stacking. In addition, because these items have extensions beyond the surface of the case, there is a potential for injury to users in the vicinity.

An example of the problems associated with stacking occurs when one is loading a number of these cases for movement by a forklift or some other lifting means where they are arranged on a pallet. Typically this arrangement will require stacking the cases in a vertical as well as a horizontal direction in an abutting disposition. A band can be used to encircle the cases once arranged in a stacked position and tightened against the cases to secure the cases in place on the pallet. Where the cases are not nested and there are the protrusions as discussed above, the band tightening effort can result in the cases, and the contents as well, being severely damaged.

The invention described herein overcomes many of the problems discussed above. The case is configured such that it can be nested against another on complementary portions of an adjacent case in at least two dimensions, in the vertical direction and the horizontal direction. This nesting feature is accomplished without detracting from the performance of the case to protect its contents.

A handle system is configured to permit each individual case to be transported by the user while not interfering with ability of the cases to be stacked in a particular direction. For this purpose, the handle is arranged in a recess and can be folded out to be grasped by the user. When retracted into the recess the handle is sufficiently removed from the other elements of the case so as not to interfere with a stacking operation.

A latching system is provided which effectively secures a cover or top portion of the case to the bottom portion. In the preferred embodiment there are two latches employed, one on opposing sides of the case. These latches include a mechanism which permits the latch to secure the top of the case in place and yet not interfere with the stacking or nesting features of the system.

In the preferred embodiment there are two types of brackets employed for stacking purposes. Corner brackets are located on each corner of the case and edge brackets are placed on the bottom portion and the top portion of the case adjacent the interface of these two portions. These corner brackets are specially configured to permit engagement with complementary corner brackets of adjacent cases for nesting in the vertical and horizontal direction. Edge brackets permit nesting when the case covers are removed. Thus, the case configuration is one which provides for stacking in a nested disposition not only during loading and unloading but while in use at a particular destination as well.

The above has been a brief description of some of the features and advantages of the invention when compared with some of the problems existing in the prior art. Other advantages can readily be perceived from a discussion of the preferred embodiments which follows.

A BRIEF DESCRIPTION OF THE DRAWINGS

FIG. 1 is a perspective view of a number of cases arranged and stacked in a nested disposition in the vertical and horizontal direction.

FIG. 1-A is an enlarged perspective view of a latching mechanism shown in a open position.

FIG. 1-B is a reduced elevation of a number of the cases stacked as shown in FIG. 1.

DETAILED DESCRIPTION OF THE PREFERRED EMBODIMENT

Figure 1:
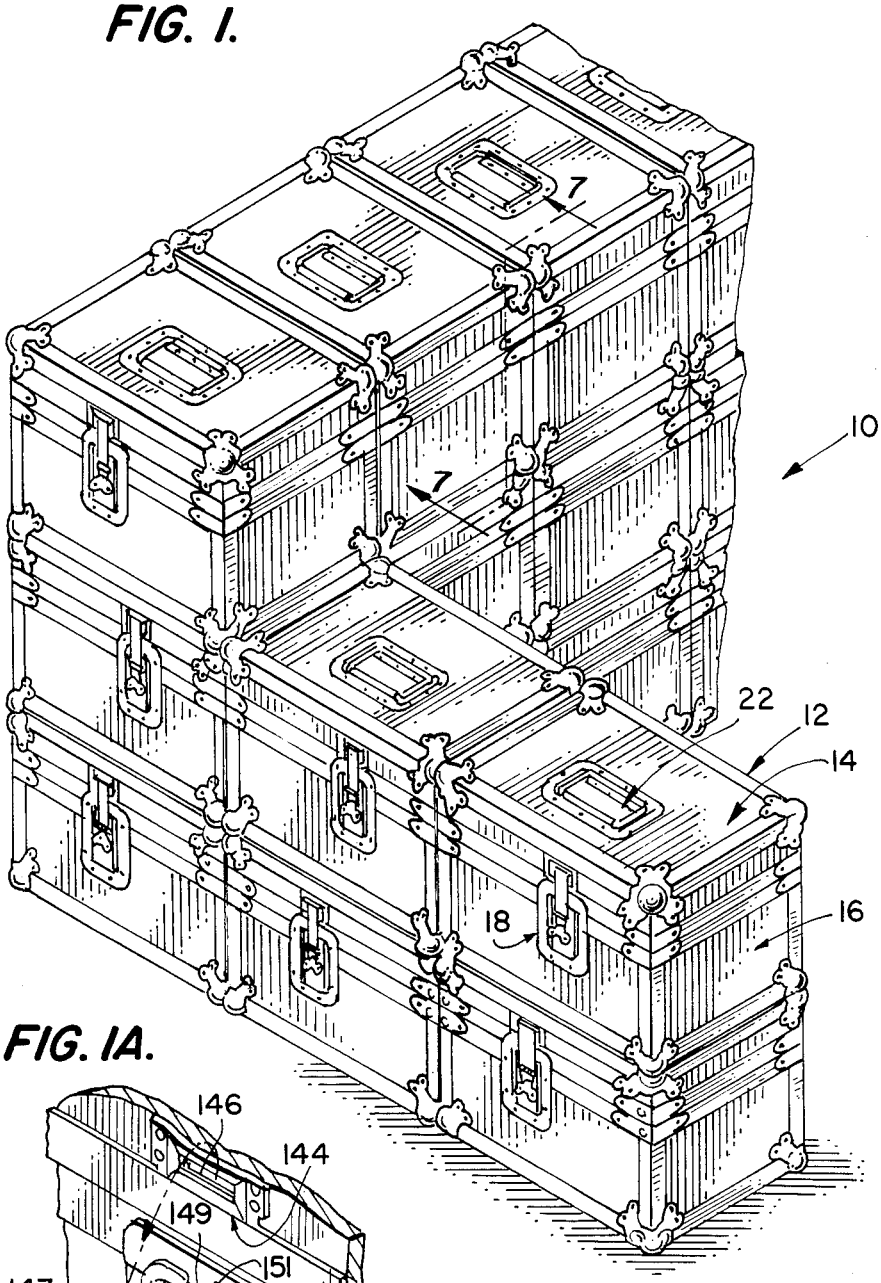
Figure 1A:
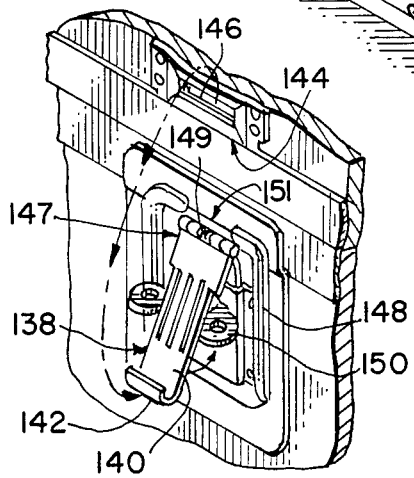
Figure 1B:
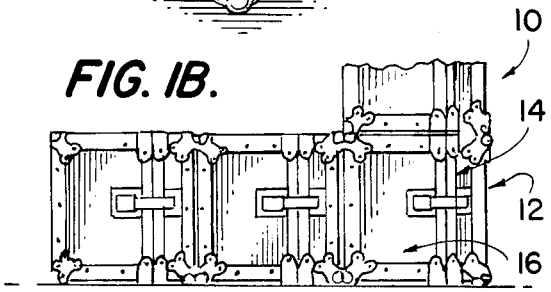

As can be seen in FIG. 1, a stack of cases 10 is shown employing a number of individual substantially identical cases 12 arranged in a nesting relationship in vertical and horizontal planes. Specifically, three cases are stacked one upon another in the vertical direction with the bottom of one case interfacing with the top of adjacent case. For horizontal direction, the cases are stacked in a row from front to rear as shown with the rear of one case in abutting relationship with the front of an adjacent case. There is also shown a number of cases arranged where the side of one case abuts against the side of an adjacent case. However, in the embodiment shown, the nesting relationship exists in the vertical direction and the front to rear direction, often referred to as the depth dimension.

As can be seen in FIG. 1, each case includes a handle mechanism 22 and a latching mechanism 18. The handle mechanism permits the case to be readily lifted in and out of its nesting position. Latch mechanism 18 secures upper portion of case 14 to lower portion of case 16. Each case includes a first latching mechanism 18 on a front face of the case at a second latching mechanism 20 on the rear face of the case. As will be discussed later, the latching mechanism is configured and located to enhance the ability of the cases to be stacked in a desired manner.

Each case includes a nesting means or mechanism for enabling the case to be stacked in an orderly manner at least in a vertical and depth direction. In this preferred embodiment, the nesting means includes a number of corner brackets 24, 26, 28, 30, 32, 34, 36 and 38 located at each corner of the case when the cover or upper portion is in the closed disposition.

A number of terms will be used in describing the relative relationship in this preferred embodiment of various elements as shown in the drawings. It should be understood that these terms are chosen simply as a matter to facilitate description of the invention and are not to be considered as limiting a location of particular elements in an absolute direction.

Figure 3:
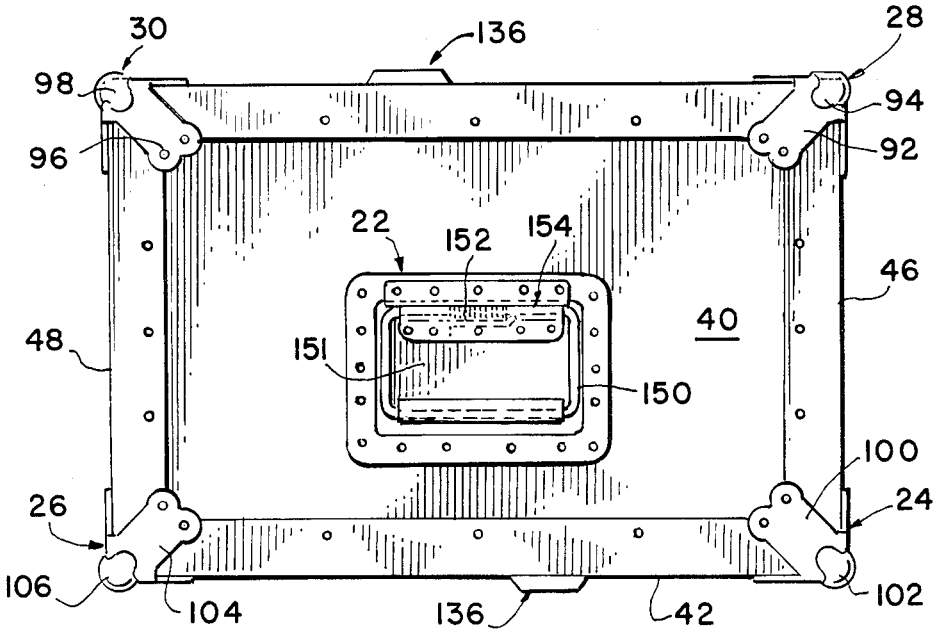
FIG. 3 is a plan view of the case viewed from the top as shown in FIG. 2.

Specifically, the nesting means includes two top corner brackets 24 and 26 and two top rear corner brackets 28 and 30 as can be seen more clearly in FIG. 3. These brackets are specifically configured to enable nesting in the vertical direction and cooperate with brackets 32, 34, 36 and 38 on the bottom of the adjacent case for this purpose, as can better be seen in FIG. 6.

Figure 6:
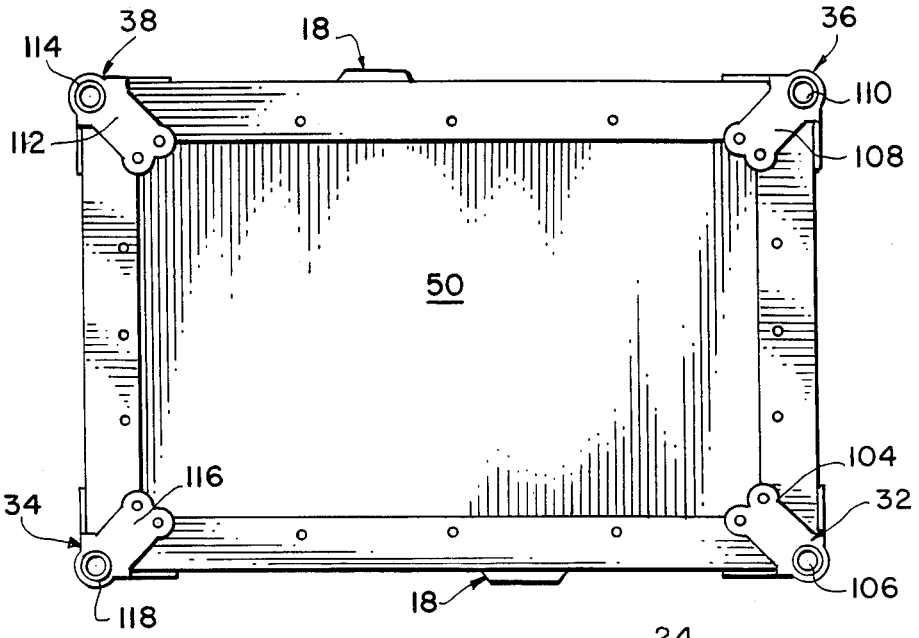
FIG. 6 is a plan view taken along lines 6—6 of FIG. 4.

The top surface 40 of upper portion or cover 14 supports a portion of the top brackets 24, 26, 28 and 30. More specifically, bracket 28 includes a portion 92 which extends over surface 40 and supports thereon a protrusion 94 in the form of a bulb of spherical configuration. Similarly, remaining brackets 30, 26 and 24 have a portion which defines respectively a portion of the bracket 96, 104, and 100 which extends over the top surface 40 each supporting its respective bulb having convex surface of spherical configuration 98, 106 and 102. Complementary engaging means are defined by the bottom portion, or the bottom 50 of each case 12 as can be seen in FIG. 6. Each bottom bracket 32, 34, 36 and 38 defines a respective portion 104, 108, 112 and 116, which extends over bottom surface 50 and supports its respective recess 106, 118, 110 and 114 having a concave surface spherical in configuration for complementary engagement with the corresponding bulb 102, 104, 94 and 98.

The features of the brackets which permit nesting in the vertical direction can be seen by noting in FIG. 1 how cases 12 are stacked on one another. Since the configuration of each case is substantially identical, recesses of one set of brackets on the bottom surface 50 of each case register with and engage the bulbs on the top surface 40 of an adjacent case. When cases 12 are stacked in a nesting relationship, recess 110 will engage bulb 102, recess 106 will engage bulb 94, and recess 114 will engage bulb 106, and recess 118 will engage bulb 98. Each bulb has as a configuration a portion of a sphere of dimensions substantially identical to the radius of curvature of the corresponding complementary recess. As a result, when nested in the manner described, the cases will generally be prevented from movement in any lateral direction. However, they can readily be moved in the vertical direction through the use of the handle simply by grabbing the handle and withdrawing the case. This enhances the stackability of the case in the vertical direction.

Figure 5:
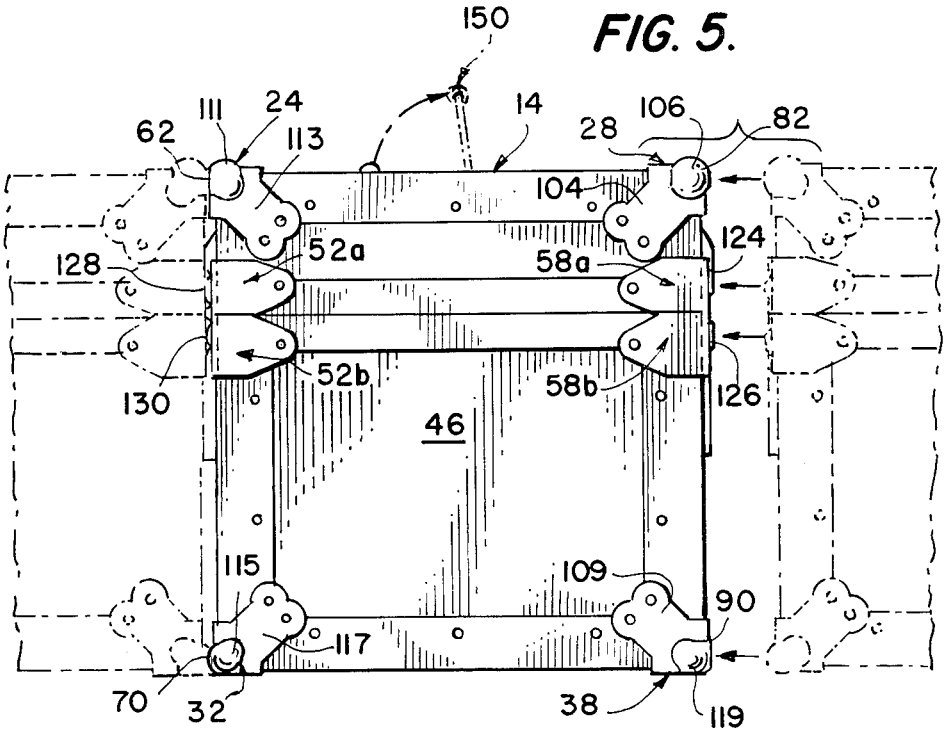
FIG. 5 is a side view taken along lines 5—5 of FIG. 4.
Figure 7:
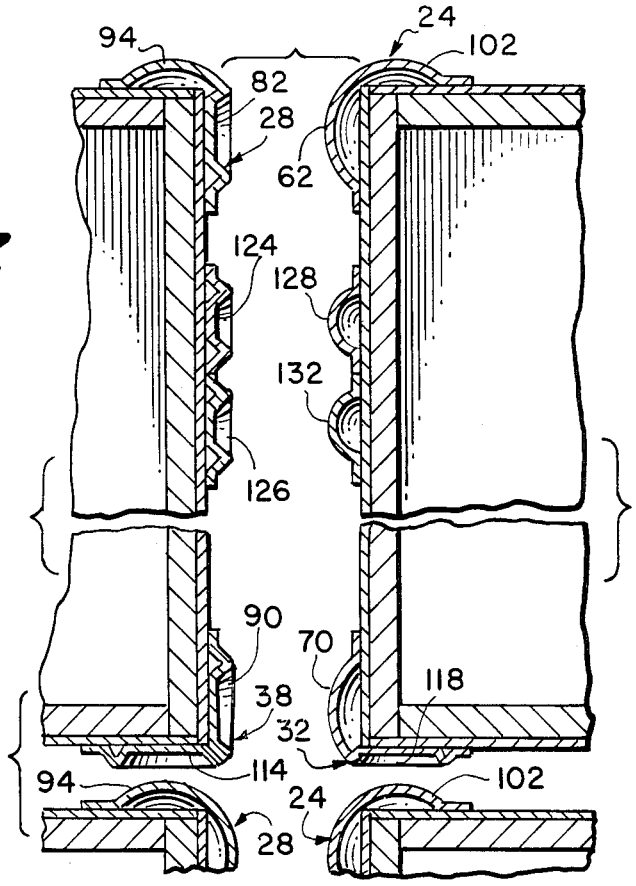
FIG. 7 is an enlarged sectional view of a portion of four cases arranged for engagement in the vertical and horizontal disposition.

These same brackets are also configured to permit nesting in the depth direction as shown in FIGS. 1, 5 and 7. For this purpose, each of the brackets 32, 24, 26 and 34 have a corresponding portion extending over the front surface 42 of the lower portion of box 12 and the front surface **42*a* of the upper portion of box 12. Specifically, bracket 32 includes portion 68 and bracket 34 includes a portion 72, each of which extends over surface 42 supports a bulb 70 and 74 respectively having the same dimensions as the bulbs described above. Similarly, brackets 24 and 26 each have respectively a portion 60 and 64 extending over the surface 42*a* and supports respectively bulb 62 and 66** having the same dimensions as the other bulbs.

Figure 4:
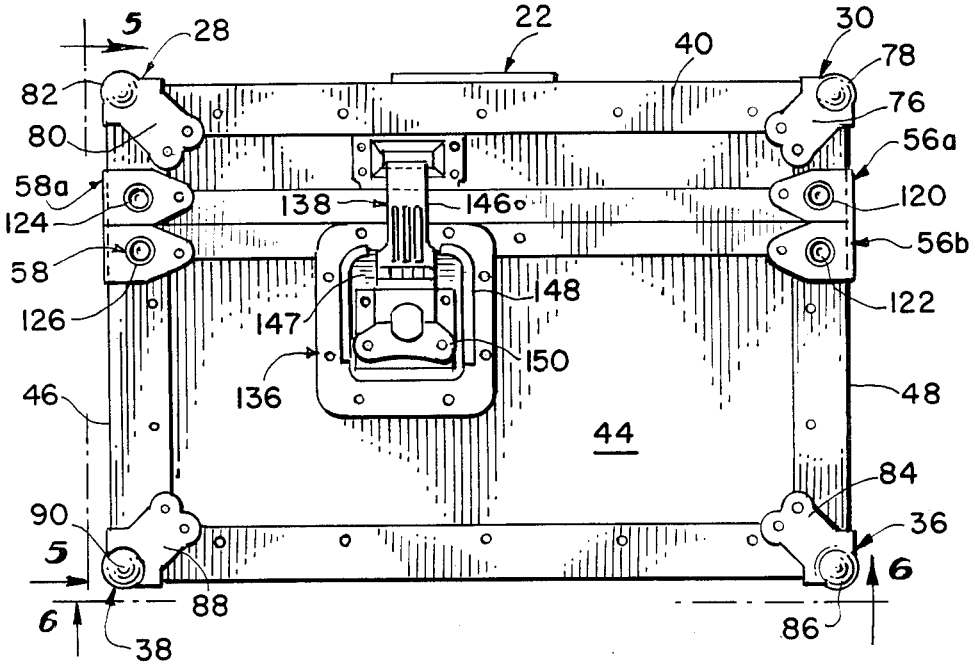
FIG. 4 is an elevation of the rear of the case as shown in FIG. 2.

The rear portion of this case, as can be seen in FIG. 4, has a number of brackets defining recesses therein for engagement with the bulbs supported on the front surface 42 and **42*a*. Specifically, brackets 36 and 38 each define respectively a portion 84 and 88 which extends over the rear surface 44 of the lower portion of case 12 and supports respectively a recess 86 and 90. Similarly, brackets 30 and 28 each define each portion 76 and 80 extending over rear portion 44*a* of the cover 14 of the case 12 support respectively recesses 78 and 82**.

Figure 2:
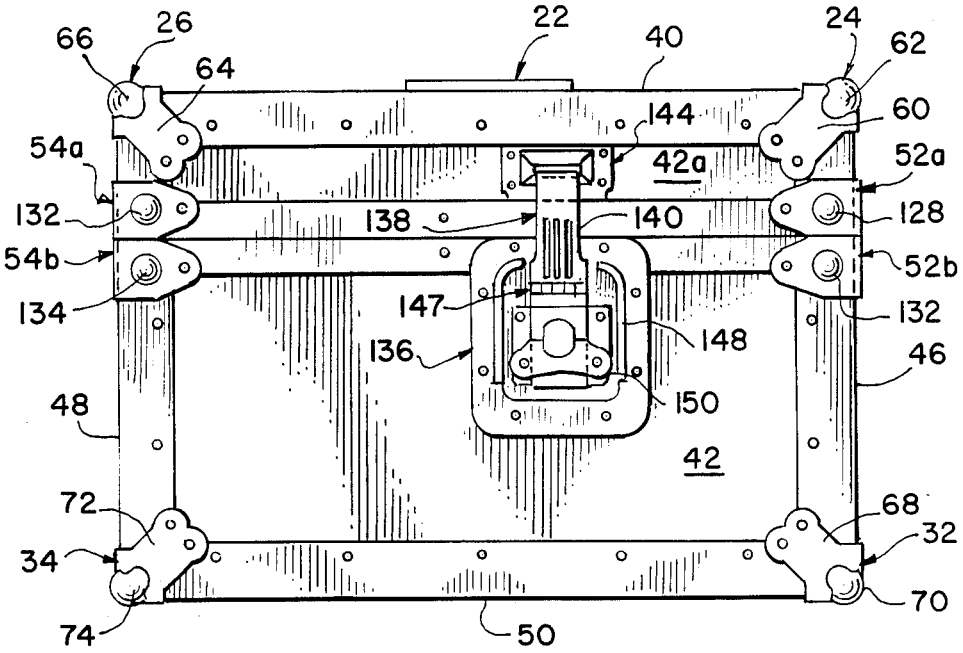
FIG. 2 is an elevation or front view of an individual case.

Each of these recesses 78, 82, 90 and 86 are configured and have the same dimensions as the recesses discussed above for engagement with the complementary bulbs 70, 72, 66 and 74 as can be seen in FIG. 2. With this configuration, the cases can be readily stacked in a nesting relationship one behind another with the recesses engaging the bulbs as can be seen in FIG. 1 in the depth direction. This will aid in preventing those cases stacked one behind the other from movement in a lateral direction and enhance transportation on a pallet or storage in small confines. However, they can readily be moved in a horizontal direction when desired to disengage the cases from one another.

It should be noted that in this preferred embodiment no nesting provision is made for the sides, although this is another alternative. As can be seen in FIG. 5 the corner brackets and edge brackets each defining portions extending over side surface 46. Specifically, corner brackets 24, 28, 38, and 32 each have a corresponding surface 113, 104, 109 and 117 which supports respectively a protrusion on bulb 111, 106, 119 and 115. The edge brackets **52*a*, 52*b*, 58*a* and 58*b* define portions extending over side surface 46 and 46*a* without any recess or protrusion. Side 48 not shown in detail is identical in configuration. However, these brackets could be configured to permit nesting in the same manner as other surfaces of the case 12**.

Figure 8:
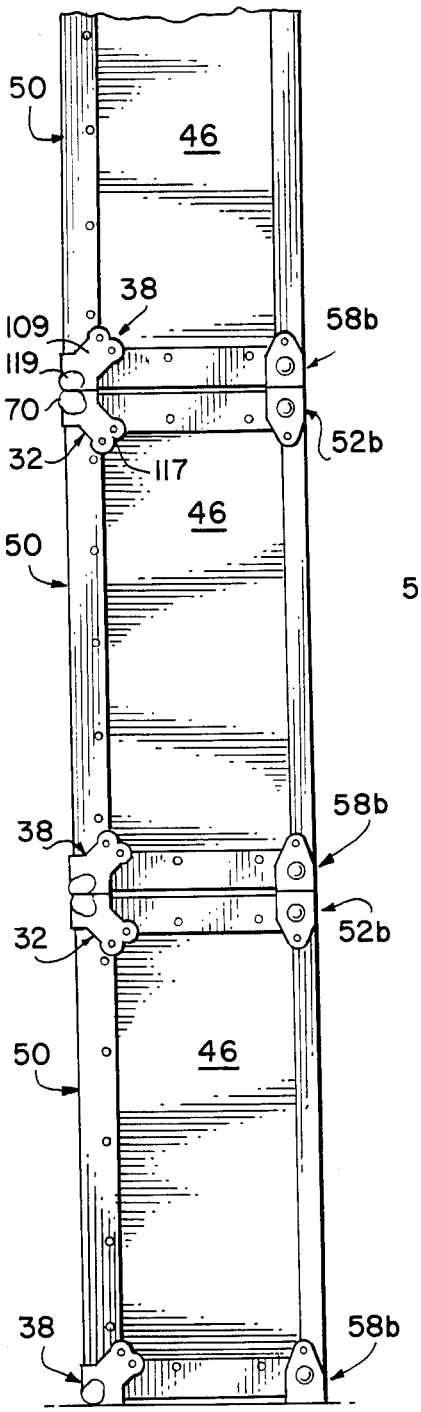
FIG. 8 is an elevation of covers removed from a lower portion of respective cases and the cases stacked in a vertical direction.
Figure 9:
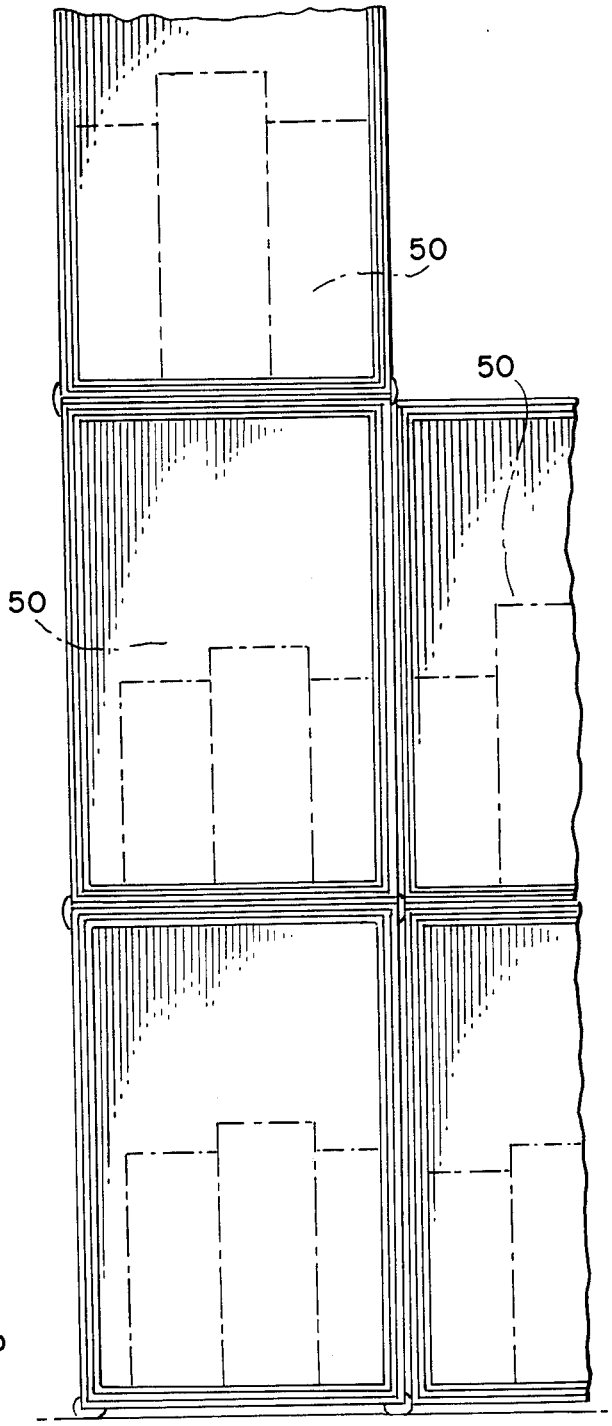
FIG. 9 is a side view of lower portions of cases stacked in a vertical direction with covers removed as shown in FIG. 8.

These cases also include means for enabling nesting of the boxes when the cover is removed and the boxes are rotated 90 degrees to move the case opening from a horizontal plane to a vertical one as can be seen more clearly in FIGS. 8 and 9. For this purpose, brackets on the front surface 40 and the rear surface 44 are configured for interengagement with one another to permit nesting. As can be seen in FIG. 2, an edge bracket **52*b* and 54*b* define a portion 129 and 133 extending over front surface 42 of case 12. These surfaces support respectively bulbs 130 and 134 each of which is spherical in configuration. Similarly, corner brackets 32 and 34 define a portion 68 and 72 extending over front surface 42 of case 12 for supporting a protrusion or spherical portion 70 and 74. As can be seen in FIG. 4, the brackets 36 and 38 each define a portion 84 and 88 respectively extending over the surface 44 and supporting respectively recess 86 and 90 for engagement with the protrusions or bulbs 74 and 70 on the front portion of an adjacent case. Similarly, bracket 56*b* and 58*b*, which is a corner bracket located at the upper edge of lower portion 16 to interface between lower portion 16 and cover 14. Each edge bracket 56*b* and 58*b* defines a portion 121 and 125 respectively extending over the rear face 44 of case 12. Each of these portions supports a recess 122 and 126 for engaging a complementary bulb 134 and 130 of brackets 52*b* and 54*b* on the front surface of the case 12**.

In operation, the covers 14 are removed and each case 12 is rotated 90 degrees such that the opening, exposed once the cover is removed, is rotated to a vertical plane and the front surface is now facing downwardly with the rear surface facing upwardly. In this position, the front and rear surfaces which had originally been facing one another in a depth direction now face one another in a vertical direction such that the recesses on the rear surface 44 engage the bulbs on the front surface 42. This can better be seen in FIG. **1*b* and FIGS. 8 and 9** where the cover has been removed. The faces of the cover and the lower portion which had previously faced one another in a depth direction with the front and rear surfaces abutting one another now find the front surface where the bottom surface had previously been and the rear surface where the top surface had previously been. In this rotated disposition the internal portions of the case are readily accessible and the case is again stacked in a vertical direction in a manner which prevents substantial movement in a horizontal direction. This nesting relationship holds the cases in place and enables them to be readily used in the field for storing various components and gaining access to them very quickly.

In FIG. 7 one can see the arrangement of these brackets as they are moved into a nesting engagement. When nested, bulbs 28 and 70 will fit or nest partially within complementary recesses 82 and 90. Similarly, bulbs 128 and 132 of the edge brackets will fit or nest partially within recesses 124 and 126. In the vertical direction bulbs 102 and 94 will fit or nest partially within recesses 118 and 114. The interaction of the bulbs and recesses prevent substantial lateral movement discussed above.

In addition to the brackets, these cases are also provided with a handle mechanism which enables the cases to be transported easily without detracting from their ability to be stacked as described above. As shown in FIG. 3 handle assembly 22 includes the handle 150 in the form of a bail which has one leg thereof hinged to upper surface 40 of cover 14 by handle bracket 154. A spring biases handle 150 in a retracted position within recess 151. The handle in a retracted position is maintained in a plane sufficiently below that of the corner brackets such that it does not interfere with the nesting operation described above.

When it is desired to be used, handle 150 can be withdrawn from recess 151 and exposed as can be seen in FIG. 5 for grasping by the user. Once the case is moved to desired position, the handle will automatically revert to a retracted position and remain stored there so as not to interfere with the stacking operation.

There is also provided a latching means or mechanism 136 for securing the cover in place until its removal is desired. The latching mechanism 136 is configured to provide sufficient latching without interferring with the stacking in a nesting arrangement. Each case 12 is provided with two systems; a front latching means 136 located on the front 42 and **42*a* of case 12 and a rear latching means 136*a* located on the rear surface 44 and 44*a* as shown in FIG. 4**.

Each latching means includes clasp 138 which consists of arm 140 having a hook portion 142 which can more clearly be seen in FIG. 1-A. Arm 140 at the end opposite the hook portion 142 is hinged to a portion of front surface 44. Arm 140 is arranged for movement in the vertical direction as shown in FIGS. 2 and 4 to permit hook portion 142 to disengage or engage a slot 146. A slot bracket 144, arranged on front surface **42*a* and correspondingly on rear surface 44*a*, defines surrounding surfaces of slot 146 for engagement by hook portion 142**.

Clasp 138 is movable between an engaged and a disengaged position by key 156. In an engaged position hook portion 142 extends into slot 146 and engages the lower surface of bracket 144 which in part defines slot 146. In the disengaged position hook portion 142 is removed from slot 146 sufficiently such that it is free from any engagement with bracket 144.

Key member 150 is foldable between a retracted position as shown in FIGS. 2 and 4 to an exposed position as shown in FIG. 1-A for operation of clasp 138. Once in the exposed position as shown in FIG. 1-A, key 156 is rotated in the clockwise direction. This rotation will cause or effect movement of clasp 138 in the vertical direction so as to disengage hook portion 142 with the slot 146. Once the position of disengagement has been reached, clasp 138 will automatically be moved away from cover 14 to a folded position as shown in FIG. 1-A. This motion is effected by a spring 149 which biases clasp in the disengaged position as shown.

Once each clasp 138 of its respective latching means 136 and 136-A has been moved into the disengaged position as shown in FIG. 1-A, the cover can then be removed. Subsequently, the cases can be stacked in the alternative position as discussed above where opening left by removing cover 14 for access to the interior portion of case 12 is exposed in a vertical plane and cases 12 can be stacked one upon another in a vertical direction with the front and rear faces abutting one another.

When stacked in this latter alternative, arm 140 will be retracted into the recess carrying the latch assembly or folded outwardly so as not to interfere with the stacking operation. It should be noted that latching mechanism 138 is retained in recess 151 in front and rear surfaces 42 and 44 respectively. Gap 151 is provided in recess 147 and particularly recess edging 148 to permit clasp 138 to extend toward slot 146 without interferring with the stacking.

The interaction of clasp 140 with the gap 149 and the retraction of key 156 maintains a profile of latching mechanism 38 below that or at least substantially equivalent to that of the nesting means as described above so as not to interfere with the nesting operation of the cases. This same operation of the clasp and the key in both the closed and open position, whether the cover is engaged or disengaged, avoids interference of the latching mechanism with the other elements of the case.

In addition to the edge brackets **56*b*, 58*b*, 52*b* and 54*b*, there are also edge brackets provided on the upper portion 14 of the case 12. Front brackets 52*a* and 54*a*, as can be seen in FIG. 2, have a portion defining bulbs 128 and 132 respectively supported on surfaces 127 and 131 which extend over the front portion 42*a* of the cover 14. Similarly, rear edge brackets 56*a* and 58*a* define a portion 119 and 123 extending over rear surface 44*a* and supporting complementary recesses 120 and 124 for engagement by the bulbs 128 and 132**.

These brackets operate in the same manner as the edge brackets on the lower portion when the cases are stacked with the front and rear surfaces in abuttment. The upper edge brackets 52a, 54a, 56a and 58a are not necessarily used when the cover is removed, but can be nested if desired. In any event they provide additional nesting means to prevent movement of the cases in a stacked disposition when the cover is in place and latched as shown in FIGS. 2, 4 and 7.

In operation, the top or cover 14 is removed from the case 12 for storing the materials to be contained therein. For this purpose, if desired, the cases could be stacked as shown in FIG. 8 while loading the materials into each individual case. Once the material is properly stored, the cases will be typically turned in the upright position such that the bottom of the cases nests on the ground or pallet and the top of the case with the cover removed is facing upwardly. The cover 14 is then placed on the lower portion of the case 16 in such a manner that the slot bracket 144 is arranged above the corresponding portion of the latch mechanism 138.

Once the top is in place, the key of the latch mechanism is moved from its retracted position to an exposed position for operation. The latch arm 140 is then moved upwardly against the bias of the spring 149 such that the hook portion 142 is in position for insertion into slot 146. The latch key is then turned counterclockwise moving the latch or clasp arm 140 upwardly where the hook portion 142 can be inserted into the slot. The key is then turned counterclockwise to its initial position for pulling the latch arm downwardly forcing hook portion 142 in to slot 146 for engaging the lower edge of the slot defined by the bracket. The latch mechanism in this position locks the top or cover 14 into place. Each latch mechanism on both sides of the case is operated in this manner. The key should be folded downwardly into the retracted position within the recess so that it does not interfere with any stacking operation. Each case is then moved into a stacked position as shown.

The cases can be stacked either in the vertical or horizontal direction initially. Assume that it is desired to stack them in the vertical direction. Once the first case has been placed on the pallet, the second case is then arranged such that the corner brackets on the bottom portion of each case nest in the corner brackets on the top portion of each case as shown. Typically, the cases are arranged in stacks of three in the vertical direction.

In the depth direction, the stacks are arranged such that the front face of each case nests into the brackets on the rear face of an abutting case. Here again, these cases are stacked having a depth of three cases. However, as shown, more cases can be used.

Normally a band can then be wrapped around the stacked cases as shown and tightened in position on the pallet so that the cases will be secured to the pallet for loading or unloading operations. Once the pallets have been delivered to their desired destination, the band is then removed. Each case is then lifted by grasping the retracted handle and moving it to an exposed position where the cases can be lifted to another location and used. If it is desired to gain access to the cases, they can be rotated 90 degrees and stacked as shown in FIG. 8. Once they are stacked in this position, the latch mechanisms are then operated as described above to unlatch each top and have them removed. Once removed, the remaining lower portions of each case remain nested against one another, again as shown in FIG. 9, where the cavities or internal portions of each case are readily accessible by the user.

It should be understood that the above has been a description of the preferred embodiment of the invention. The claims which follow are intended to cover the full scope of the invention to which applicant is entitled and any modifications and equivalents thereof.

We claim:

1. A case comprising:

(a) an upper portion;

(b) a lower portion;

(c) said lower portion having a cavity for receiving materials therein and said upper portion being movable between an open position for exposing said cavity and a closed position for covering said cavity;

(d) said case when said upper portion is in a closed position having two front top corner brackets, two top rear corner brackets, said top corner brackets on said upper portion two, front bottom corner brackets, and two rear bottom corner brackets, said bottom corner brackets being located on said bottom portion; and (e) said upper portion and said lower portion each having a front surface, a rear surface, a first side wall and a second side wall, said upper portion defining a top surface and said bottom portion defining a bottom surface;

(f) said brackets having means for nesting case with another case having a substantially same configuration in a stacked disposition in two dimensions;

(g) said means for nesting said boxes in two dimensions includes means for nesting in a vertical direction wherein the bottom surface of on case is contiguous to the top surface of an adjacent case and in a horizontal direction wherein the rear surface of one case is contiguous to the front surface of an adjacent case;

(h) said two front bottom brackets and two rear bottom brackets each having a bottom portion extending over the bottom surface of said case, and each of said bottom portions of said bottom brackets extending over the bottom surface including one of a recess and protrusion defined therein; said two front top brackets and two rear top brackets each have a portion extending over the top surface of said case, and each defining one of a complementary protrusion and recess for engaging a corresponding recess or protrusion of said bottom brackets in a nesting relationship;

(i) said two top rear brackets and said two bottom rear brackets each having a rear portion extending over the rear surface of said case and said rear portion of each rear bracket having one of a recess and a protrusion therein; said two front top brackets and said two front bottom brackets each having a front portion extending over the front surface of said case, said front portion of each front bracket having a complementary protrusion or recess for engaging the corresponding recess or protrusion of the rear portion of said rear brackets in a nesting relationship; and (j) said corner brackets cooperating to permit the nesting of the upper portion of said case with the bottom portion of an adjacent case and rear surface of said case with the front surface of an adjacent case permitting cases stacked with bottom portion nested on top portion of an adjacent case to be rotated for stacking with rear surface and front surfaces in a nesting relationship.

2. The case according to claim 1, wherein said protrusion is a bulb having a convex configuration, and said complementary portion is a recess of a concave configuration having an effective radius of curvature substantially identical to that of the bulb.

3. The case according to claim 2, wherein said upper portion is cover for covering said recess in said closed position and the top surface of said cover supports a handle for carrying said case.

4. The case according to claim 3, wherein a cover recess is defined in the cover, said handle being located within said recess and movable between a retracted position and an extended position where the handle is exposed for use, said handle having a dimension when in the closed position substantially no portion of the handle extends above the plane of the cover.

5. The case according to claim 4, wherein said handle includes bias means for biasing said handle in said retracted position.

6. The case according to claim 5 further comprising a first releasable locking means for securing said cover to said lower portion and being releasable to permit removal of said cover from said lower portion.

7. The case according to claim 6, wherein said first releasable locking means includes a key movable between a folded and an upright position, a recess into the front wall of said case, said recess being of a sufficient depth to receive the key in the folded position without any portion of the key extending substantially beyond the plane of the front surface of the case.

8. The case according to claim 7, wherein a first member on the front surface of said cover and said first locking means includes a first latch movable between an engaged position for engaging said first member and a disengaged position removed from said first member.

9. The case according to claim 8 further comprising a second locking mans located on the rear surface of the case, a second member, a second latch movable between an engaged position for engaging said second member and a disengaged position removed from said second member.

10. The case according to claim 9, wherein each latch is biased toward a disengaged position.

11. The case according to claim 10, wherein each latch includes a hook portion, each of said member is a bracket secured to the front surface of said cover defining a slot, said hook portion releasably engagable with a portion of said bracket defining said slot.

12. The case according to claim 11, wherein said first and second locking means are offset relative to one another for avoiding interengagement during stacking.

13. The case according to claim 12 further comprising a first edge nesting means on the lower portion, front surface of said case displaced from said brackets on said lower portion, and complementary second edge nesting means on the lower portion, rear surface of said case and displaced from said brackets.

14. The case according to claim 13, wherein said first edge nesting members include protrusions and said second edge nesting members include complementary recesses for engagement by said protrusions of said first edge nesting members.

15. The case according to claim 14, wherein said edge nesting members are located adjacent the interface of said upper and lower portions of said case.

16. The case according to claim 15 wherein said nesting member are brackets.

17. The case according to claim 16 wherein said cover defining third edge brackets having protrusions extending therefrom and a fourth set of edge brackets having complementary recesses for engaging the protrusions of said third set of edge brackets.

18. The case according to claim 17 wherein each of said first edge brackets and said third edge brackets having a portion extending along the front face of said case and a portion extending along the side faces of said case, the portion along the front edge of said case defining said protrusions; each of said second and fourth edge brackets having a portion extending along said rear face of said surface of said case and a portion extending along the side faces of said case, wherein the portions extending along the rear face define said complementary recesses for receiving said protrusions.

19. The case according to claim 1 wherein said top portion includes top edge brackets located adjacent the interface between said top portion and said bottom portion; said edge bracket cooperating with said corner brackets on said top portion to permit the top portion when removed form said bottom portion to be arranged in a nested relationship with the front surface of one top portion in contiguous relationship with the rear surface of an adjacent top portion.

20. The case according to claim 19 wherein said top portion has the same peripheral dimensions as said bottom portion and a lesser depth dimension than said bottom portion.

21. The case according to claim 19 further comprising bottom edge brackets located adjacent the interface between said top portion and said bottom portion, said bottom edge bracket cooperating with said corner brackets on said bottom portion to permit the bottom portion when said top portion is removed to be arranged in a nested relationship with the rear surface of one bottom portion in contiguous relationship with the front surface of and adjacent top portion.

* * * * *